United States Patent [19]

Becker et al.

[11] 4,262,909

[45] Apr. 21, 1981

[54] GAME APPARATUS

[76] Inventors: Joseph T. Becker, 2 S. 214 Sheffield, Glen Ellyn, Ill. 60137; Byron L. Doran, 1725 LaPalma Ct., Wheaton, Ill. 60187; Patrick J. Perretti, 1634 Downing Ave., Westchester, Ill. 60153

[21] Appl. No.: 827,220

[22] Filed: Aug. 24, 1977

[51] Int. Cl.[3] ..... A63B 59/00; A63B 65/00; A63B 67/18

[52] U.S. Cl. ..... 273/323; 273/412; 273/417

[58] Field of Search ..... 273/106 A, 106 R, 96 R, 273/323, 326, 412, 417, 419, 420

[56] References Cited

U.S. PATENT DOCUMENTS

| | | | |
|---|---|---|---|
| 578,491 | 3/1897 | Knowles | 273/96 R |
| 2,218,593 | 10/1940 | Ushakoff | 273/106 A |
| 2,734,746 | 2/1956 | Sametz et al. | 273/106 A |
| 2,930,618 | 3/1960 | Glintz | 273/96 R |
| 3,108,807 | 10/1963 | Ruehle | 273/96 R |

FOREIGN PATENT DOCUMENTS

| | | | |
|---|---|---|---|
| 1048210 | 12/1958 | Fed. Rep. of Germany | 273/106 A |
| 2327607 | 12/1974 | Fed. Rep. of Germany | 273/96 R |
| 1156174 | 12/1957 | France | 273/106 A |
| 824778 | 12/1959 | United Kingdom | 273/106 A |

*Primary Examiner*—Paul E. Shapiro
*Attorney, Agent, or Firm*—James T. Fitzgibbon

[57] ABSTRACT

A game apparatus having a projectile or thrown element and one or more receiver elements. The projectile element comprises a soft, preferably weighted nose portion received within the open end of a projectile body which is formed from a thin plastic material and which is of frustoconical shape. The body is hollow and open at the larger end thereof. The receiving element has means for accommodating the nose portion of the projectile, preferably, an open end, and is comprised of a frustoconical hollow body with an enlarged open end and having a size and taper generally corresponding to that of the projectile portion. In use, the projectile is thrown by one of the players and the other player or players attempt to catch it in the cone shaped receiver by directing the open end of the receiver towards the incoming projectile. The sufficient taper provides safety and the cone configuration affords stable flight to the projectile and presents a reception opening which is specially adapted to catch the projectile.

5 Claims, 5 Drawing Figures

FIG. 1
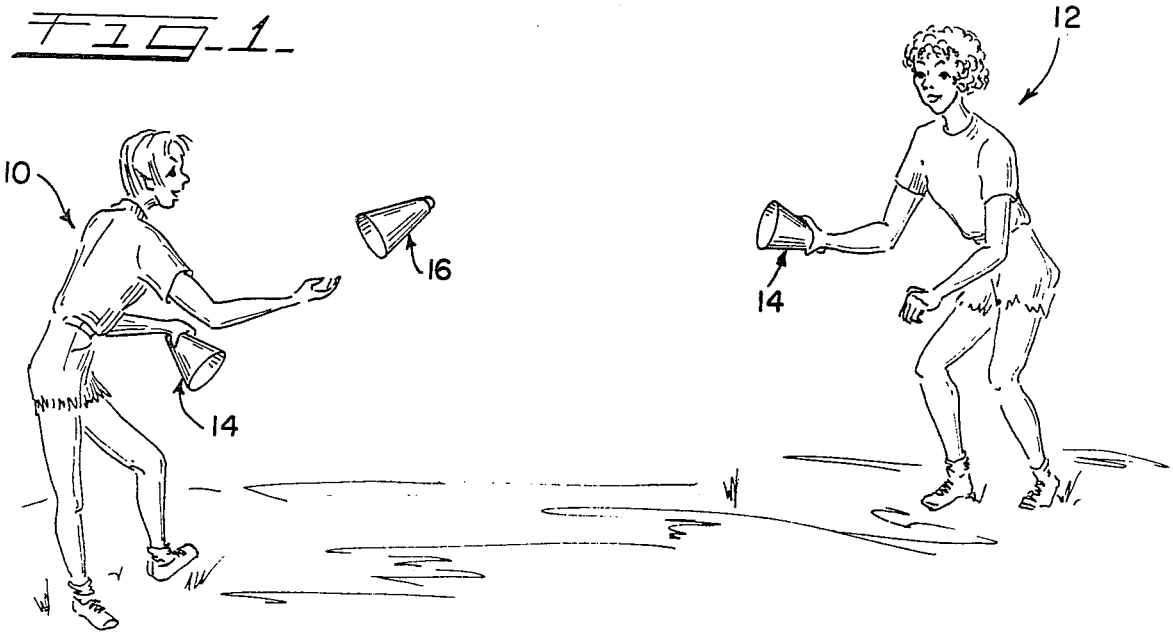
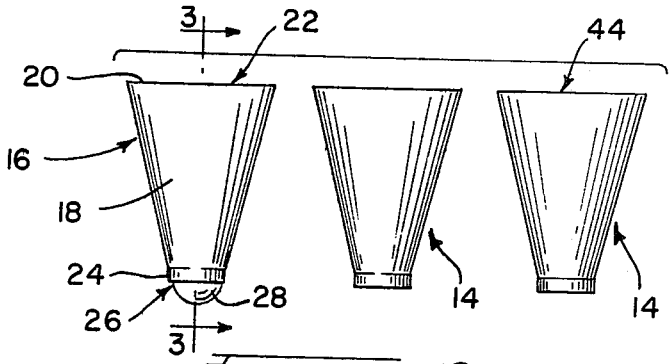
FIG. 2
FIG. 3
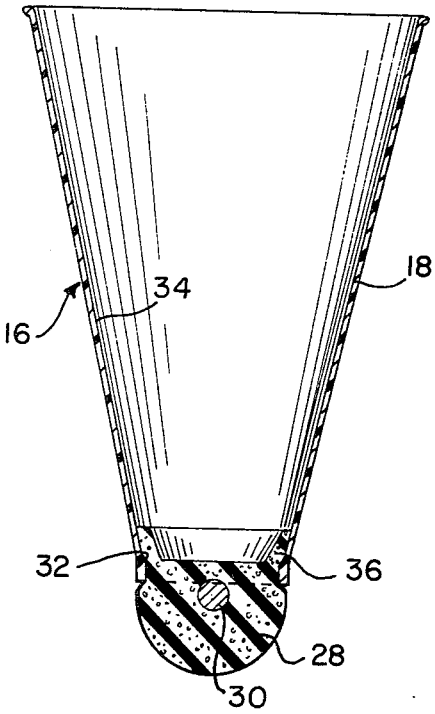
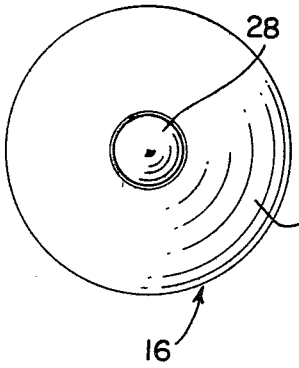
FIG. 4
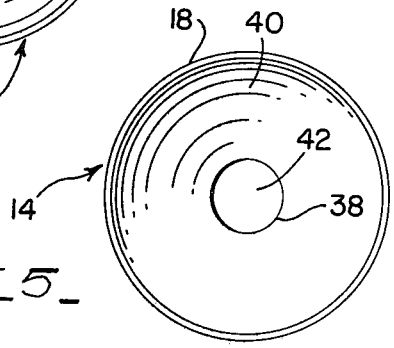
FIG. 5

GAME APPARATUS

BACKGROUND OF THE INVENTION

The present invention relates generally to a game, and more particularly to a catch-and-toss type game using a projectile unit and a receiver or catcher unit. The game develops player skills in throwing and catching as well as providing diversion and enjoyment for the players.

According to the invention, a game is provided which is capable of increasing the eye-hand co-ordination skills of the players, and which is adaptable to greatly different skill levels without change of equipment or loss of enjoyment. In view of the continuing need for games which promote healthy exercise, which develop co-ordination without danger during playing, which appeal to and are adapted to be enjoyed by players having wide variety of co-ordination and which can be played and enjoyed by different age groups, it is an object of the present invention to provide a game apparatus of novel construction.

Another object of the invention is to provide a throw-and-catch type game which uses simple and inexpensive equipment.

Still another object of the invention is to provide a throw-and-catch-type game using specially designed apparatus which may be thrown with varying trajectories depending upon the skill and practice of the players.

Yet another object is to provide playing apparatus for a game which is inexpensive and which is easily understood, even by small children.

A further object is to provide playing apparatus for a game which can be played outdoors and which involves a projectile toy but which is very safe and harmless.

A still further object is to provide playing apparatus for a game which simultaneously tests the throwing skill of one player and the catching skill of another player.

Another object is to provide playing elements of a game in which a projectile is thrown back and forth between players, which is caught by them, in special receivers, and in which the projectile is of a conical shape which adapts it to a stable configuration in flight.

A still further object of the invention is to provide a game apparatus including a projectile toy which includes a soft nose portion and a body having a gradually tapered, hollow cone.

Another object is to provide a game apparatus in which the projectile portion of the apparatus has a body of a shape which is a congruent or identical shape to that of the receiver, and wherein both are of a generally cone-shaped configuration.

The foregoing and other advantages and objects of the invention are achieved in practice by providing a throw-and-catch type game apparatus including at least one truncated cone-shaped receiving apparatus having a thin wall and an open end portion, and wherein the thrown element of the toy includes a truncated, hollow conical body of thin wall construction and further includes a nose piece of a soft and resilient but durable material.

The manner in which these and other objects and advantages are achieved in practice will become more apparent when reference is made to the following detailed description of the preferred embodiments of the invention set forth by way of example and shown in the accompanying drawing, wherein like reference numbers indicate corresponding parts throughout.

BRIEF DESCRIPTION OF THE DRAWINGS

FIG. 1 is a perspective view showing two players engaging in a throw-and-catch type game using the apparatus of the invention;

FIG. 2 is a side elevational view showing the throwing element and the catching apparatus, and showing the similar shapes of the body portions of these articles;

FIG. 3 is a vertical sectional view, on an enlarged scale, showing the cross-section of the projectile element and taken along lines 3—3 of FIG. 2;

FIG. 4 is an elevational view, taken from the front and showing the projectile portion of the apparatus shown in FIGS. 1–3; and FIG. 5 is an elevational view, taken from the enlarged open end of the receiver element of the apparatus.

DESCRIPTION OF THE PREFERRED EMBODIMENTS OF THE INVENTION

While it will be understood that the invention is susceptible of different embodiments, a description will be made of a preferred form thereof made from a thin thermoplastic material for low cost in which the cones are approximately eight to ten inches in length and three to seven inches in diameter at the open end thereof.

Referring now to the drawings in greater detail, FIG. 1 shows a pair of players generally designated 10 and 12 to be playing the game, with the player 10 holding a receiving unit 14 in one hand and throwing the projectile unit 16 from his other hand. The player 12 is grasping a counterpart receiving unit 14 in his right hand and is shown to be manipulating the open end thereof so as to attempt to register it with and catch the incoming projectile 16 thrown by the player 10.

In FIG. 2, there is shown a typical apparatus adapted to play this game including the projectile element 16 and a pair of receiving elements 14. The projectile element 16 includes a frustoconical body portion 18, including an enlarged diameter margin 20 extending around the body and defining a rear opening 22. The forward portion includes a reduced diameter margin 24 defining an opening 26 in which is received a nose portion 28. As shown in FIG. 3, the nose portion 28 may include a centrally disposed weight 30 or the like. The inner margin 32 of the inner surface 34 of the body 18 is secured to an annular flange 36 which forms a part of the nose portion 28. These parts may be secured together by an interference fit, by adhesives, or by engagement of a locking bead or the like between the cone body 18 and the nose portion 28. FIG. 4 shows that the nose portion 28 is disposed centrally of the body 18 of the projectile 16, while FIG. 5 shows that, in the receiver unit 14, the inner margins 38 of the inside surface 40 of the sidewall 18, define an opening 42 which is sized and shaped so as to receive the nose portion 28 of the projectile element 16 such that the units 14 and 16 will nest with each other. Accordingly, catching the projectile element 16 by the receiver 14 requires skill, but the game can be readily mastered by skilled players.

Referring now to other aspects of the game, it has been determined that different trajectories may be imparted to the projectile portion or element 16 depending upon the manner in which it is gripped and the force with which it is thrown. This adds variety and challenge to the catch game conducted by the players.

The provision of soft material for the nose portion 28 provides a safety feature, and in the preferred form, a small weight 30 or the like disposed in the nose improves the flight trajectory. The frustoconical shape of the projectile device 16 has proved to provide outstanding stability in flight, and the projectile will fly through the air in a nose first attitude when thrown in a high, low or moderate arc or trajectory. The hollow construction of the device reduces overall weight and increases safety, without compromising the ability to throw the device 30 to 50 feet or more.

The attempt to catch the projectile portion 16 in the receiver 14 adds an extra element of skill and co-ordination to the game which requires relatively accurate positioning of the open end portion 44 of the receiver, readily gained after a reasonable amount of practice. The game has proven to provide enjoyment and exercise and is an apparatus which is inexpensive, which may be nested for storage, and which is safe and rugged in use.

It will thus be seen that the present invention provides a novel toss-and-catch game apparatus having a number of advantages and characteristics including those pointed out above and others which are inherent in the invention. A preferred embodiment of the invention having been described by way of illustration, it is anticipated that changes and modifications of the described toss-and-catch game apparatus will occur to those skilled in the art and that such changes and modifications may be made without departing from the spirit of the invention or the scope of the appended claims.

I claim:

1. A toss and catch type game apparatus comprising, in combination, a projectile element and at least one projectile reception element, said projectile element comprising a body portion and a nose portion, said body portion being of hollow, frusto-conical configuration and defined by having a thin, imperforate outer sidewall, said sidewall having first and second circumferential margins defining, respectively, smaller and larger ends of said body, said nose portion of said projectile element being partially received within and closing off said smaller end of said body, said nose portion being made from a soft, at least partially resilient mass of material having a rounded front section, said reception element comprising essentially only a body portion having sidewalls of substantially identical shape with respect to the sidewalls of the body portion of said projectile element, said reception element being adapted to receive said projectile portion therein in nesting relation, with at least a portion of said nose extending through the smaller opening in said body portion, said reception element being able to be grasped by the exterior surface of the body portion thereof for manipulation by an operator with the large end thereof directed to the nose portion of the projectile for catching said projectile within said body portion of said reception element to arrest the flight of said projectile.

2. A toss-and-catch game apparatus as defined in claim 1 wherein said nose portion is made from a rubbery sponge material.

3. A toss-and-catch game apparatus as defined in claim 1 wherein said nose portion includes a weight embedded therein.

4. A toss-and-catch game apparatus as defined in claim 1 wherein said sidewall portions are formed from a resilient thermoplastic material.

5. A toss-and-catch game apparatus as defined in claim 1 wherein said nose portion extends outwardly through the smaller end portion of said body and wherein an enlarged diameter flange is provided on said nose for engagement with the inner margin of said smaller end of said body.

* * * * *